US005373428A

United States Patent [19]

Day

[11] Patent Number: 5,373,428

[45] Date of Patent: Dec. 13, 1994

[54] LIGHTBOX FOR DISPLAY PURPOSES

[75] Inventor: Peter Day, Bedford, England

[73] Assignee: Showcard Systems Retail Limited, Hertfordshire, England

[21] Appl. No.: 7,414

[22] Filed: Jan. 22, 1993

[30] Foreign Application Priority Data

Jan. 24, 1992 [GB] United Kingdom ..... 9201503.1

[51] Int. Cl.[5] ..... F21S 3/00

[52] U.S. Cl. ..... 362/223; 362/97; 362/812; 40/574

[58] Field of Search ..... 40/574, 575; 362/223, 362/224, 97, 812

[56] References Cited

U.S. PATENT DOCUMENTS

| | | | |
|---|---|---|---|
| 2,643,328 | 6/1953 | Elmendorf | 362/224 |
| 2,726,319 | 12/1955 | Williamson | 362/223 |
| 3,056,222 | 10/1962 | Boudouris | 40/574 |
| 4,081,665 | 3/1978 | Corbeil | 40/574 |
| 4,157,584 | 6/1979 | Bhatt | 40/574 |
| 4,580,200 | 4/1986 | Hess et al. | 362/223 |
| 4,667,275 | 5/1987 | Herst et al. | 362/223 |
| 4,766,685 | 8/1988 | Kramer | 40/574 |
| 5,136,490 | 8/1992 | Morrison | 362/373 |
| 5,138,541 | 8/1992 | Kano | 362/373 |

FOREIGN PATENT DOCUMENTS

| | | | |
|---|---|---|---|
| 1074281 | 3/1980 | Canada | 240/52 |
| 2217960 | 10/1973 | Germany | 40/574 |
| 8910055 | 1/1990 | Germany . | |
| 9001489 | 5/1990 | Germany . | |
| 1302164 | 1/1973 | United Kingdom . | |
| 2105896A | 3/1983 | United Kingdom . | |

*Primary Examiner*—Richard A. Bertsch
*Assistant Examiner*—M. Kocharov
*Attorney, Agent, or Firm*—Seidel, Gonda, Lavorgna & Monaco

[57] ABSTRACT

A lightbox for display purposes, such as advertising, comprises a rigid back plate adapted to be secured to a support surface, a light source carried by the back plate, and a front fascia of clear plastics material which can be flexed and which is held in place in a curved attitude on the back plate by the engagement of fastening means between the fascia and back plate. The fascia comprises outer and inner panels which sandwich a photographic transparency therebetween. Flexing of the fascia for mounting on the back plate causes the two panels to come into area contact with the transparency. Release of the fascia from the back plate causes the panels to be loosened and enables the transparency to be removed.

9 Claims, 4 Drawing Sheets

LIGHTBOX FOR DISPLAY PURPOSES

FIELD OF THE INVENTION

This invention relates to lightboxes for use for display purposes. The invention is particularly concerned with lightboxes which can be used for advertising or for point of sale display purposes or to impart information. Such lightboxes are used in shops, hotels, public areas and the like, wherever an eye-catching display is required.

SUMMARY OF THE PRIOR ART

Conventionally, such lightboxes for display purposes comprise a box-like housing which is secured to a wall or other rigid structure, with a display panel carrying a photographic transparency for example being secured in place on the housing by means of a peripheral surround. The use of a peripheral surround is aesthetically unattractive and it also means that one cannot easily or quickly replace the transparency. One has to dismantle the whole unit and then re-assemble it afterwards.

It has been an objective of the designers of lightboxes over the years to make the units slimmer, i.e. in thickness from front to back, primarily for aesthetic reasons. However, with the conventional lightboxes, as one makes them slimmer so one has the problem of "barring", i.e. the appearance of bands or bars of lighter and darker areas on the illuminated transparency, due to the proximity of the transparency to the fluorescent tubes which illuminate the transparency from behind. This is a particularly noticeable problem with transparencies which are light.

Yet a further problem with conventional lightboxes which have a peripheral surround and which are therefore effectively closed units is the problem of condensation within the lightbox due to fluctuating temperatures.

SUMMARY OF THE INVENTION

It is an object of the present invention to provide a lightbox for display purposes which is aesthetically more attractive than such conventional lightboxes in that it has a curved display panel and requires no peripheral surround to hold the panel in place. Not only does this make the lightbox aesthetically more attractive, but it facilitates the changing of the photographic transparency, as will become apparent hereinafter.

It is a further object of the invention to provide a lightbox which is slim in appearance but which does not have the problem of "barring".

Broadly in accordance with the present invention there is provided a lightbox for display purposes comprising a back plate arranged to be secured to a rigid support surface, a front fascia, and a light source between the back plate and the fascia, wherein the front fascia can be flexed and is held in place in a curved attitude on the back plate by fastening means between the fascia and the back plate.

In a preferred embodiment of the lightbox, the fascia is affixed to the back plate at one side margin of the fascia and is engageable by hook means with the back plate at the other side margin, the release of the fascia from the back plate being effected by a flexing of the fascia to disengage the hook means.

Preferably, the fascia comprises an outer panel and an inner panel of clear plastics material which define a slot therebetween to receive a transparency to be displayed, wherein the flexing of the fascia for the mounting of the fascia on the back plate causes the panels to be brought into area contact with the transparency therebetween. Release of the fascia from the back plate causes the panels of the fascia to be loosened in relation to each other, thereby enabling the transparency to be removed and a replacement to be inserted without difficulty.

The resulting lightbox has an aesthetically pleasing curved configuration to the fascia, with no peripheral surround to mar the appearance. The fittings are concealed behind the fascia. In spite of the curvature of the fascia there is no barring of the illuminated transparency: there is even distribution of lighting over the whole surface area. The problem of barring is mainly dependent upon the distance between the light source and the illuminated transparency. In conventional flat-fronted lightboxes, a slim box will mean that the distance between light source and transparency is small, giving rise to the problem. With the use of the curved fascia of the present invention, although the lightbox appears slim overall, there is still a substantial spacing between light source and transparency, especially at the centre of the unit, and the problem is minimised.

BRIEF DESCRIPTION OF THE DRAWINGS

In order that the invention may be more fully understood, one presently preferred embodiment of lightbox will now be described by way of example and with reference to the accompanying drawings, in which.

DESCRIPTION OF THE PREFERRED EMBODIMENT

Figure 1:
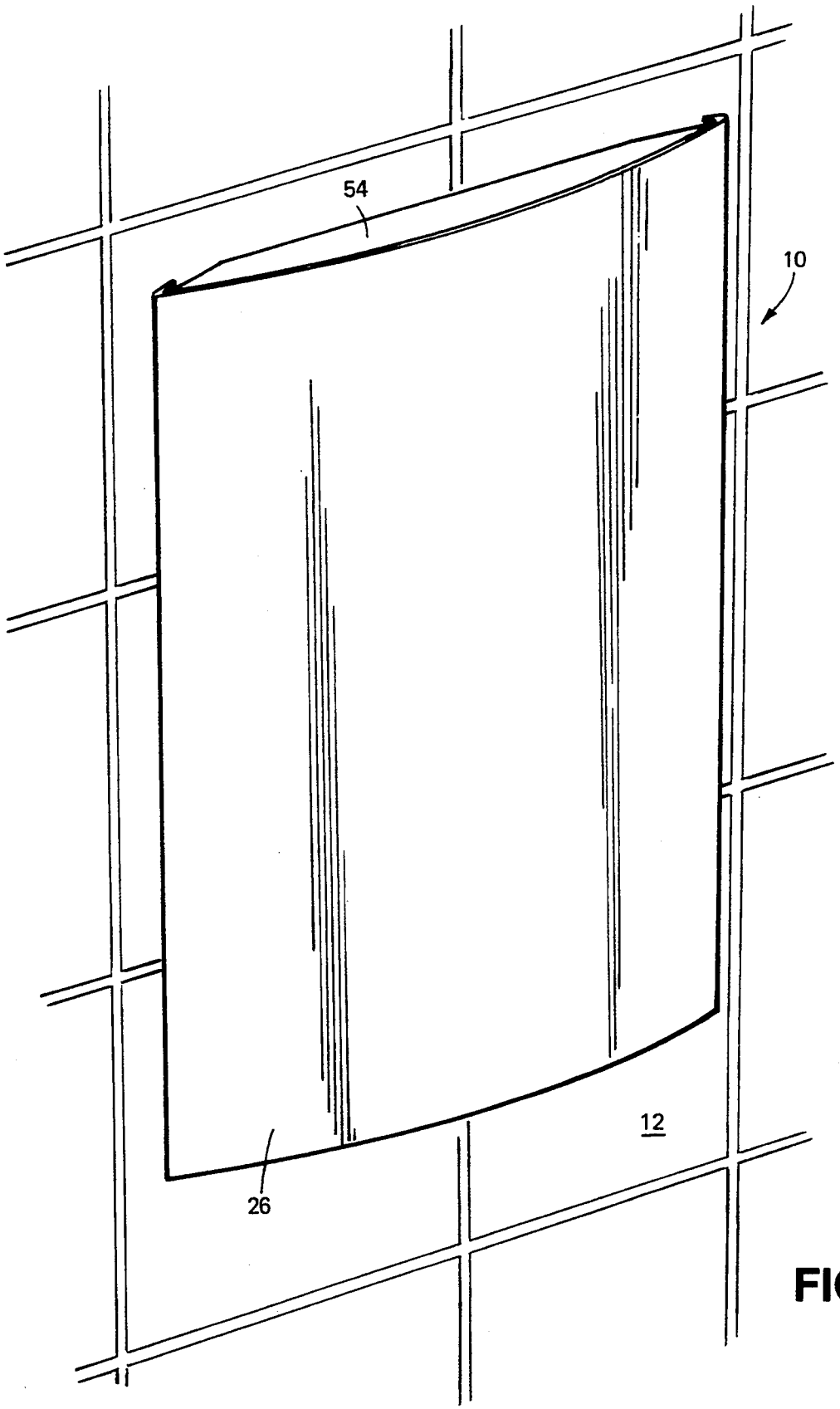
FIG. 1 is a schematic perspective view of the lightbox in accordance with the invention, shown mounted on a wall.

The lightbox of the present invention is shown in its assembled state in FIG. 1, where it is indicated generally at 10. In FIG. 1 it is shown mounted on a wall 12 or other fixed receiving surface. It will be apparent from FIG. 1 that the lightbox has a convexly curved configuration at the front and lies very close to the wall surface at each side.

Figure 2:
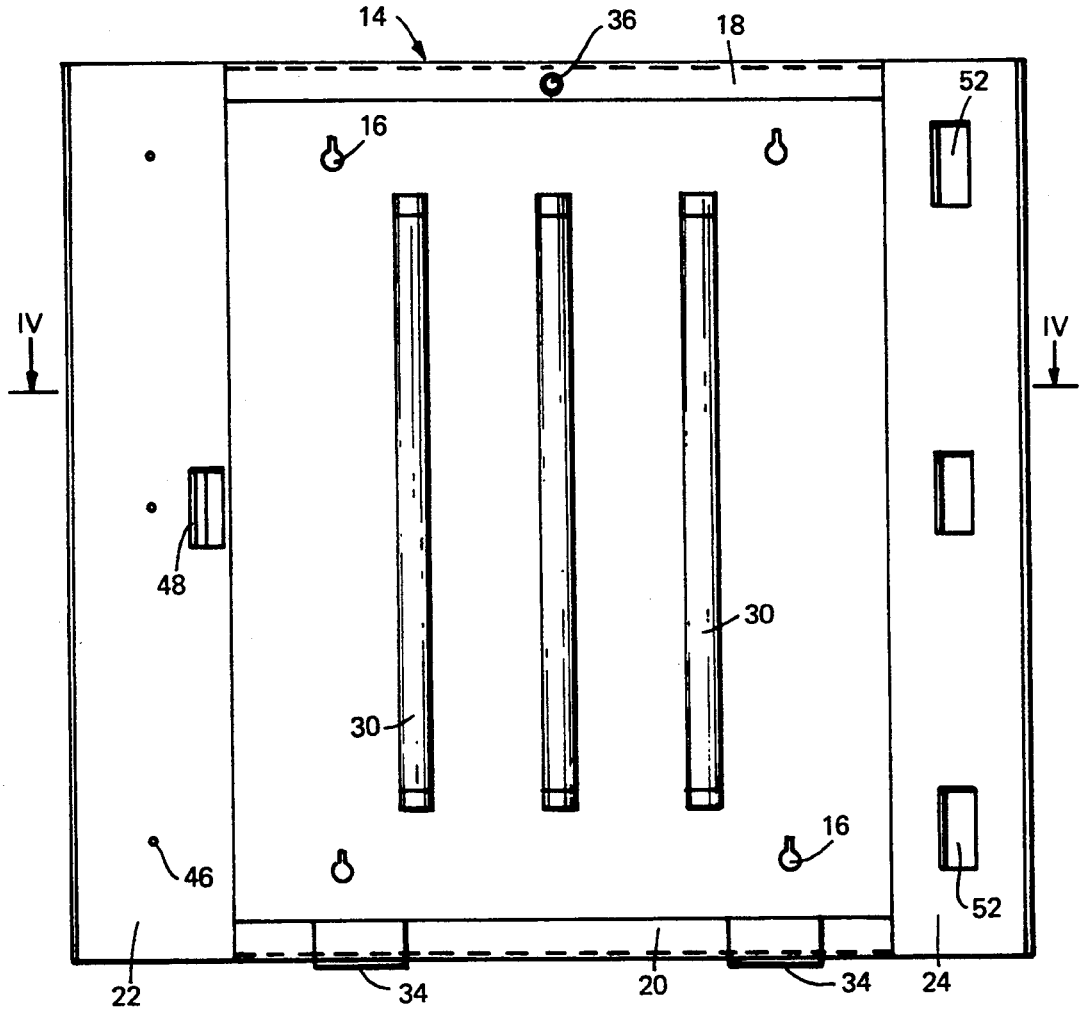
FIG. 2 is a front elevation of the back plate of the lightbox which is affixed to a support surface.
Figure 3:
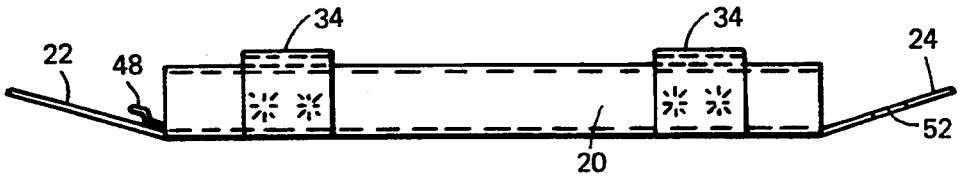
FIG. 3 is a bottom plan view of the back plate of FIG. 2.

As shown most clearly in FIGS. 2 and 3, the lightbox comprises a generally rectangular back plate, indicated generally at 14, which is provided with a suitable plurality of keyhole slots 16 arranged to receive screws by means of which the back plate can be secured to the wall 12 or other rigid support surface which is to carry the lightbox. The upper and lower margins of the back plate 14 are provided with an outwardly projecting flange 18 and 20 respectively. The flanges 18, 20 extend perpendicular to the plane of the centre section of the back plate. At each side, the back plate 14 is bent forwards to define a pair of side flanges 22, 24. These side flanges 22, 24 are bent forward at an angle of about 15° to the plane of the centre section of the back plate.

The back plate 14 provides a fixing for a fascia of the lightbox. As shown most clearly in FIGS. 4 and 5, the fascia consists of an outer panel 26 and an inner panel 28 of transparent plastics material, for example an acrylic plastics material. Conveniently, each of the two panels 26, 28 can be made from 2 mm thick plastics sheet. In use, a photographic transparency or other art work to be illuminated and displayed is sandwiched between the two panels 26, 28 of the fascia. The back plate 14 is provided on the centre section with a plurality of appropriately spaced fluorescent lamps 30 which provide illumination for the transparency held in the fascia. The lamps 30 are provided in a sufficient number and at appropriate spacings to ensure even illumination over the whole area of the fascia. Here, three such lamps 30 are shown by way of example. A clear plastics panel 32 is mounted in front of the lamps 30 as a protective measure, so that when the front fascia is removed the panel 32 protects the lamps 30 against accidental damage. The panel 32 is seated at the bottom in two brackets 34 which are welded to the bottom of the lower flange 20 of the back plate. The upstanding front edge of each bracket 34, together with the flange 20, define two horizontally spaced receiving slots which take the lower edge of the panel 32. At the top the panel can be secured by a fixing screw received in a hole 36 in the upper flange 18.

The inner panel 28 of the front fascia is provided with a single angled return portion 38 at one side edge, for example a 100 mm angled return, and fits inside the outer panel 26 which is provided with two angled return portions, a first return portion 40 overlapping the angled return portion 38 of the inner panel and a second angled return portion 42 at the other side. The side edge of the inner panel 28 which is remote from the angled return portion 38 of that panel is located within the angle formed by the return portion 42 of the outer panel.

The panels of the fascia are fitted to the metal back plate 14 in the following manner. At the side of the lightbox where the fascia has two overlapping return portions 38 and 40, a number of screws 44 are set through the side flange 22 of the back plate, as indicated by the fixing holes 46 in FIG. 2, and pass through the two fascia panels 26, 28. The screws 44 are fitted with suitable tightening and/or lock nuts. A locating bracket 48 is fitted to the side flange 22 of the back plate, approximately half way down the plate, to act as a locator for the angled return portions 38 and 40 of the fascia panels. Alternatively, more than one such locating bracket can be provided on the side flange of the back plate. This fixing acts like a hinge down one side of the lightbox. The margins of the fascia panels are held in place by the locating bracket or brackets 48 and the screws 44 ensure that the fascia is held fast to the back plate.

Figure 5:
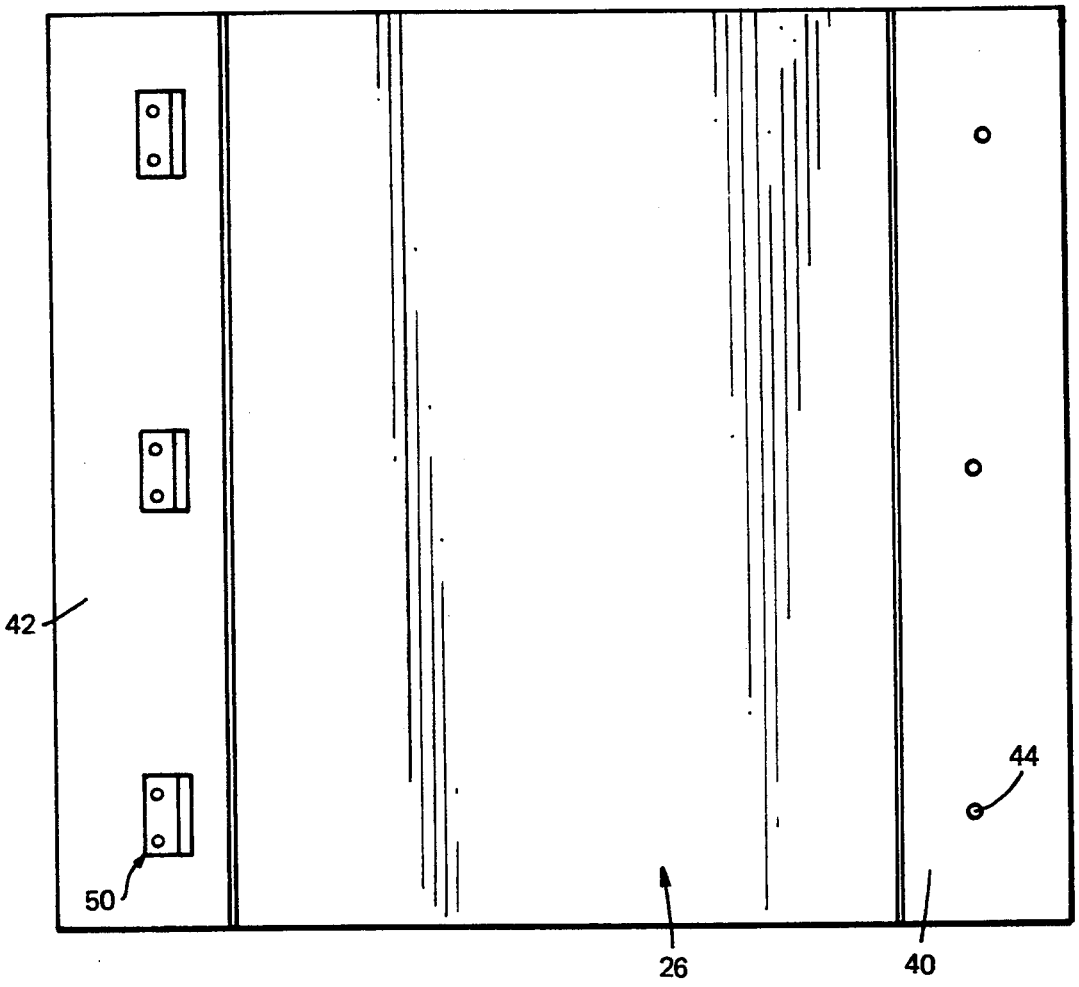

On the other side of the lightbox, a plurality, here three, hook brackets 50 are fitted to the outer surface of the angled return portion 42 of the outer fascia panel 26. The hook brackets 50 are substantially J-shaped in cross-section, with the longer limb secured to the return portion 42 and with the shorter, outer limb being arranged to latch into a rectangular hole 52 in the side flange 24 of the back plate. FIG. 5 shows three such hook brackets 50 spaced vertically down the front panel 26 and FIG. 2 shows the three corresponding holes 52 in the side flange 24.

Figure 4:
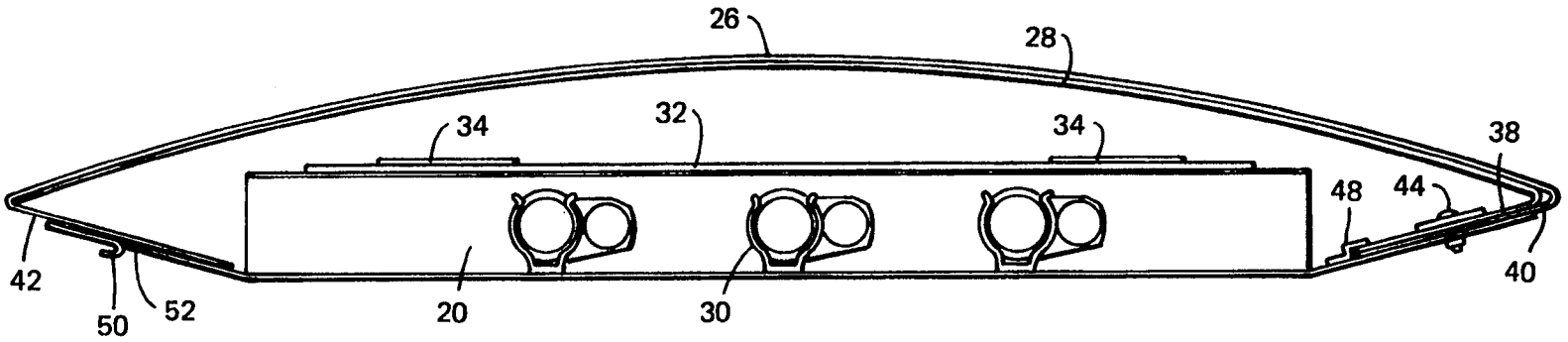
FIG. 4 is a horizontal section through the lightbox taken along the line IV—IV in FIG. 2; and, FIG. 5 is a rear view of the front panel of the fascia.

The fascia plates 26, 28 are dimensioned in relation to the back plate 14 so that the fascia has to be flexed into a curved configuration (as illustrated in FIG. 4) in order to be fitted to the back plate. With the semi-permanent fastening of the fascia to the back plate down the one side of the lightbox by the screws 44, it is then simply necessary to flex the fascia and latch the hook brackets 50 into the holes 52 in order to secure the fascia in place. This flexing of the fascia into its curved configuration also causes the two fascia panels 26 and 28 to be brought into face-to-face abutting contact over the full overlapping area of the two panels. In order to fit or change a photographic transparency or other artwork for display purposes, the fascia is squeezed from the side in order to release the hook brackets from the holes 52. This immediately gives freedom for movement between the outer and inner panels 26, 28 of the fascia, to open up a slot between the two panels into which one can fit a transparency. By then squeezing the fascia and applying pressure to the side, the fascia is caused to flex until the hook brackets 50 can be relocated in the holes 52. This also causes the transparency to be pressed evenly between the two panels 26, 28 of the fascia.

A panel 54, for example of 3 mm acrylic plastics material, is fitted both at the top and at the bottom of the lightbox, as shown most clearly in FIG. 1, in order substantially to fill the gaps at the top and bottom of the lightbox created by the curvature of the fascia. The panels 54 can be screwed or riveted or otherwise secured to the inturned flanges 18 and 20 of the back plate 14. If the lightbox is to be used indoors or in an environment where it is protected from the weather then the panels 54 are dimensioned so that they have a curved front edge which lies spaced from the correspondingly curved inside surface of the inner panel 28 of the front fascia. By thus leaving a gap between the top and bottom panels 54 and the front fascia at both the top and the bottom of the lightbox one permits air to pass through the lightbox, generally in an upward direction, and thereby avoids or minimises the problems of condensation which could otherwise arise as a result of fluctuations in temperature.

Although the presently preferred embodiment of lightbox described above is generally rectangular in shape, a shape which lends itself particularly well to the principles behind the present invention, the invention is not limited to that shape of lightbox and other shapes, for example hexagonal, could alternatively be used, with appropriate shaping of the parts of the lightbox and with suitable latching means to hold the fascia in place on the back plate. The hook brackets 50 and holes 52 are one example only of suitable latching means for holding the fascia in place on the back plate. Various other means of securing the fascia to the back plate could be devised by one skilled in this art. For example, a snap-fitting mechanism could be used, requiring simply that the fascia be pushed directly against the back plate in order to effect engagement of the two parts.

One particular advantage of the lightbox of the present invention is that one dispenses with the need for a peripheral surround around the fascia 26, 28. Not only does this improve the appearance of the lightbox, but it also facilitates the fitting and replacement of transparencies in the fascia. Instead of having to dismantle the peripheral surround before being able to fit or replace a transparency, one simply has to disengage the fastening at one side of the lightbox and slide the transparency out of or into the slot between the fascia panels 26, 28.

If the lightbox is to be used outdoors then the back plate is modified so that it has flange portions at top and bottom which project forwards sufficiently to shield the fascia and prevent the ingress of water behind the fascia.

The present invention may be embodied in other specific forms without departing from the spirit or essential attributes thereof and, accordingly, reference should be made to the appended claims, rather than to the foregoing specification, as indicating the scope of the invention.

I claim:

1. A lightbox for display purposes, comprising:

a back plate for securement to a rigid support surface;

a front fascia comprising an outer panel and an inner panel both of transparent material between which sheet-form display material can be inserted;

a light source between the back plate and the fascia;

first fastening means at one side of the fascia securing the fascia to the back plate at said one side; and second fastening means at the other side of the fascia to permit detachable engagement of said other side of the fascia with the back plate, wherein said second fastening means comprises hook means providing latching engagement between the fascia and the back plate, the disengagement of the hook means being effected by a squeezing flexure of the fascia from the sides;

wherein disengagement of said second fastening means permits partial separation of said outer and inner panels for the insertion of sheet-form display material therebetween, and engagement of said second fastening means consequent on flexing of the outer and inner panels into a curved attitude causes the outer and inner panels to be brought into area contact one with the other, wherein the outer panel has an angled portion at said other side of the fascia, wherein said hook means are arranged spaced down the outer panel on said return portion, and wherein apertures are provided in said back plate to receive the hook means.

2. A lightbox according to claim 1, wherein the fascia is dimensioned in relation to the back plate so that the fascia has to be flexed into a curved configuration in order to be fitted in place over the back plate.

3. A lightbox according to claim 1, in which the fascia has angled return portions at said one side and at said other side.

4. A lightbox according to claim 1, in which the outer panel has an angled return portion at said one side and at said other side and the inner panel has an angled return portion at said one side only.

5. A lightbox according to claim 1, in which the back plate has a flat centre portion and side portions which are bent forward from the plane of the centre portion, the light source being carried by the centre portion, the first fastening means being secured to one of said side portions, and the second fastening means being detachably engageable with the other side portion.

6. A lightbox according to claim 1, wherein the fascia is resilient to the extent that the fascia outer and inner panels have limited pivotal movement about a vertical axis when said hook means are disengaged.

7. A lightbox according to claim 1, which includes top and bottom panels behind the fascia and carried by the back plate, the top and bottom panels being dimensioned so as to define a gap between the front edge of said panel and the adjacent curved surface of the fascia.

8. A lightbox for display purposes, comprising a back plate arranged to be secured to a rigid support surface, a front fascia comprising an outer panel and an inner panel of transparent plastics material between which sheet-form display material can be inserted, and a light source between the back plate and the fascia, wherein the fascia is flexible and is held in place in a curved attitude on the back plate by fastening means between the fascia and the back plate, and wherein the outer panel has an angled return portion at each side and the inner panel has an angled return portion at one side only, the side of the fascia having the two return portions being secured to the back plate and the side of the fascia having only one return portion being detachably engageable with the back plate.

9. A lightbox for display purposes comprising:

a back plate for securement to a rigid support surface;

a front fascia comprising an outer panel and an inner panel both of transparent material between which sheet-form display material can be inserted;

a light source between the back plate and the fascia;

first fastening means at one side of the fascia securing the fascia to the back plate at said one side; and second fastening means at the other side of the fascia to permit detachable engagement of said other side of the fascia with the back plate;

wherein disengagement of said second fastening means permits partial separation of said outer and inner panels for the insertion of sheet-form display material therebetween, and engagement of said second fastening means consequent on flexing of the outer and inner panels into a curved attitude causes the outer and inner panels to be brought into area contact with one another, wherein the outer panel has an angled return portion at said one side and at said other side, and wherein the inner panel has an angled return portion only at said one side.

* * * * *